US006571877B1

(12) United States Patent
Van Bilderbeek

(10) Patent No.: US 6,571,877 B1
(45) Date of Patent: Jun. 3, 2003

(54) WELLHEAD

(75) Inventor: Ben Van Bilderbeek, London (GB)

(73) Assignee: Plexus Ocean Systems Limited (GB)

( * ) Notice: Subject to any disclaimer, the term of this patent is extended or adjusted under 35 U.S.C. 154(b) by 0 days.

(21) Appl. No.: 09/099,653

(22) Filed: Jun. 17, 1998

(30) Foreign Application Priority Data

Jun. 17, 1997 (GB) ..... 9712469

(51) Int. Cl.[7] ..... E21B 33/047

(52) U.S. Cl. ..... 166/339; 166/348; 166/360; 166/368

(58) Field of Search ..... 166/338, 339, 166/344, 348, 356, 360, 368

(56) References Cited

U.S. PATENT DOCUMENTS

| | | | | |
|---|---|---|---|---|
| 3,625,283 A | * | 12/1971 | Ahlstone | 166/330 |
| 3,926,457 A | * | 12/1975 | Williams et al. | 166/125 X |
| 4,116,044 A | * | 9/1978 | Garrett | |
| 4,757,860 A | * | 7/1988 | Reimert | 166/208 |
| 5,031,696 A | * | 7/1991 | Zwiegel | 166/208 |

FOREIGN PATENT DOCUMENTS

GB 2 254 635 10/1992

* cited by examiner

*Primary Examiner*—Roger Schoeppel

(74) *Attorney, Agent, or Firm*—Cook, Alex, McFarron, Manzo, Cummings & Mehler, Ltd.

(57) ABSTRACT

In the drilling of a well, a dedicated drilling wellhead (520) mounted at the top of the casing cluster whilst the well is being drilled. At the end of drilling, a seal ring or sleeve (534) which during the drilling phase has the function of an annular sleeve isolating the well bore pressure from the production annulus space (540), is manipulated into an alternative position in which it acts to block the annular space (540) thereby acting as a temporary abandonment seal. A further plug seal is fitted in the well bore. The well is now temporarily sealed and the drilling wellhead can then be removed and can be reused on another well during the drilling phase of that well. A production wellhead (550,556) which has a cantilever christmas tree fitted on its side over a production wellhead (557) which can accept a conventional christmas tree on top is then fitted on to the casing hanger cluster. Prior to installation of the tubing hanger the seal ring sleeve (534) can be manipulated back into its upper position from where it seals the production annulus (540) from the well bore while allowing monitoring of the production annulus (540) through the outlet port (542).

19 Claims, 17 Drawing Sheets

WELLHEAD

This invention relates to wellheads for oil and gas wells. For convenience of description, reference will be made in this specification solely to oil wells, but it is to be understood that the invention extends equally to gas wells, gas or oil storage wells and geothermal wells.

In oil wells, there are two distinct phases, firstly exploration and drilling and secondly production. Once a successful well has been drilled, it must either be in production or kept sealed else the oil may escape.

Conventional technique is to secure a wellhead assembly to a surface casing on the ground (either on the surface or subsea), and to use that wellhead as a base both for drilling the well and for subsequent production. This has disadvantages. In the drilling phase, the wellhead is liable to damage as a result of the insertion and extraction of drill bits and drill rods, and from the evacuation through the well of the drilling mud and debris. Damage to the wellhead at this stage can necessitate expensive replacements, even before production has commenced.

On the other hand, production considerations demand a tightly engineered wellhead both to withstand the pressures generated from within the well and to ensure that the wellhead remains serviceable over a period of possibly as long as 40 years.

According to the invention, there is provided a method of drilling a well and preparing it for production, the method comprising the steps of providing, for the drilling stage, a drilling wellhead and when drilling is completed, sealing the well and production annulus; installing a production wellhead on the well and then unsealing the well bore and opening communication with the production annulus so that production can take place through the production wellhead whilst the production annulus is monitored.

With such a method, the drilling wellhead can be manufactured to relatively low cost specifications, and can be reused for the drilling of a number of wells. The drilling wellhead can even be hired out to well operators for drilling wells as it will only be in use at a particular well site for a limited period of time.

The production wellhead which is installed after the well has been drilled can thus be assured of being unlikely to suffer damage of the type possible when drilling rods and bits would have to pass through it were it to be in situ during the drilling phase.

After drilling has been completed through the drilling wellhead and prior to installation of the production wellhead, the well can be sealed by isolating the annular space surrounding the production casing, and by fitting a sealing cap within the production casing.

The drilling wellhead can then be removed from the casing hanger cluster to allow replacement by the production wellhead. A tubing hanger can be fitted into the production wellhead after unsealing of the casing bore and the annular space surrounding the production casing.

The production annulus can be provided with a seal ring which is axially movable between a sealing position for sealing the annulus and an open position for opening communication with the annulus. The seal ring can be mounted on a thread and can be moved between sealing and open positions by rotating the ring on its thread. This movement can be achieved with a tool inserted axially into the well.

Preferably the seal ring seals with the production wellhead and with the production casing when in the open position.

In a particularly preferred embodiment, the seal ring also forms a wellhead bowl protector.

The invention also provides wellhead apparatus comprising a casing hanger cluster comprising a plurality of concentric casing hangers, a seal ring which can be moved axially in the cluster to open and close communication between an annular space defined between the production casing hanger in the cluster and the next outermost casing hanger, a drilling wellhead and a production wellhead, the drilling and production wellheads being adapted to be fitted alternately on the cluster.

The seal ring may comprise a tubular body, with seals on its radially internal and radially external faces which seal with, respectively, the radially external face of one casing string and the radially internal face of a next outermost casing string.

Alternatively the seal ring may comprise a cylindrical body with at least two sets of seals on radially external faces, the seals being arranged at different diameters, the smaller diameter set of seals being arranged to seal with one casing hanger and the larger diameter set being arranged to seal with a next outermost casing hanger at a point where the next outermost casing hanger is not overlapped by the said one casing hanger.

The seal ring may have an axially extending skirt which acts as a bowl protector in the wellhead. The ring can have one set of seals at one end, and a second set carried by the lower end of the skirt.

The seal ring can have surfaces which make metal/metal seals with mating faces of the casing strings.

In one embodiment, the seal ring is in two parts which are held in a first relative position by a shear pin. A compression seal can be located between the two parts, the compression seal being uncompressed when the parts are in their first relative position, but being compressed when the parts move to a second relative position after the shear pin has sheared.

The seal ring can have an upper tapered surface for making a metal/metal seal with a corresponding surface of a production wellhead, and a lower tapered surface for making a metal/metal seal with a corresponding surface of a production casing hanger. The seal ring preferably also has O-ring seals for sealing with inner and outer casing strings and with a production wellhead.

The seal ring can be mounted on a thread, and can be moved between the seal open and seal closed positions by rotating the ring on its thread.

Further sealing/valving functions can be provided in the production wellhead, such as a ball valve (rotatable 90 degrees between open and closed positions) and/or a pressure relief plug.

The wellhead apparatus can also include a removable tubing hanger section, at the top of the tubing hanger, which is exposed to possible damage during use of the well, and which can be readily removed and replaced at low cost if it should become damaged.

The invention will now be further described, by way of example, with reference to the accompanying drawings, in which:

FIG. 1 shows the first stages in the forming of a well. The operations shown and described here are carried out at or close to the ground 8.

Figure 1:
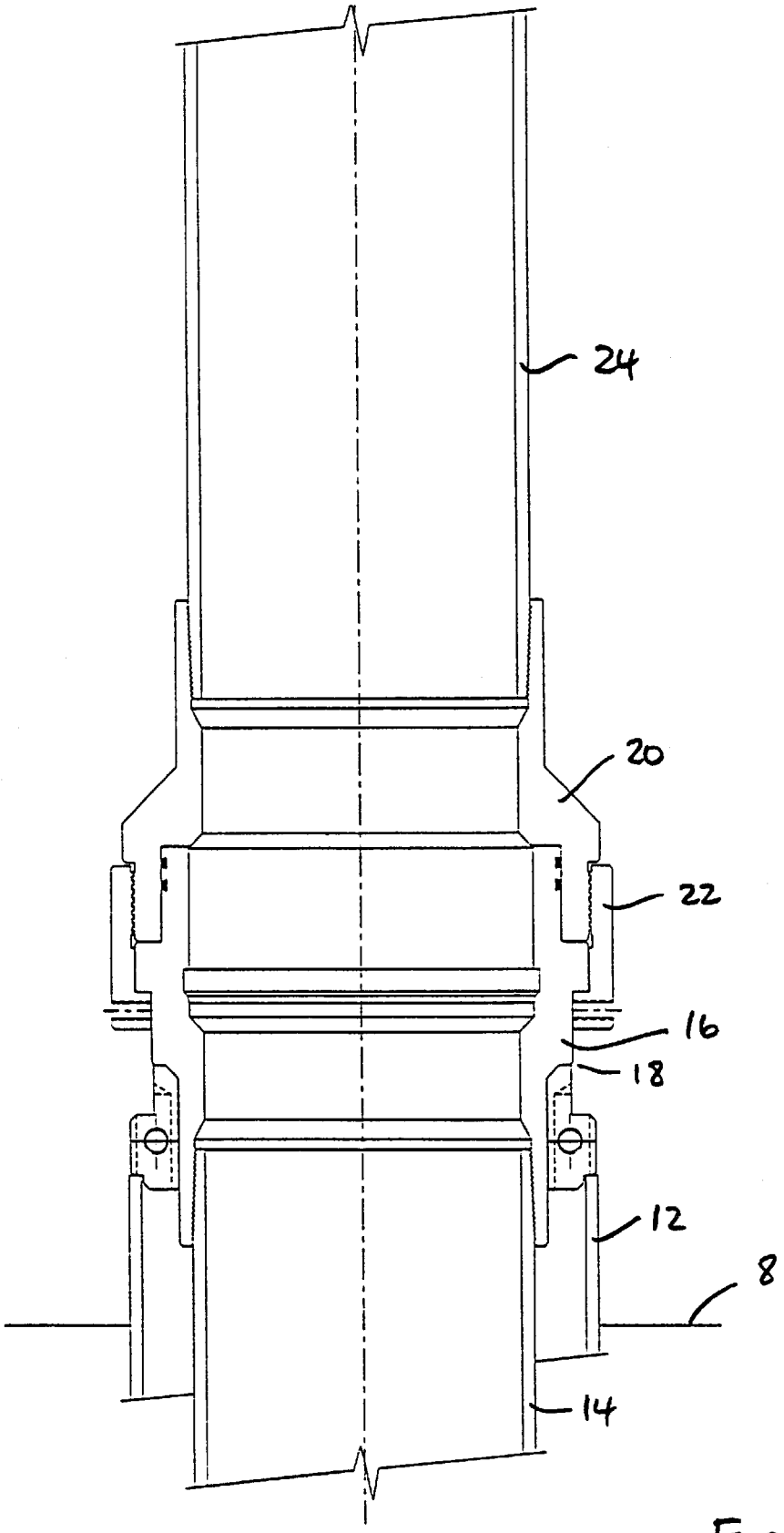
FIGS. 1 to 9 show a sequence of stages in the production of a well in accordance with the invention, and the preparation of that well for production.

The first stage is the installation of an outer conductor 12 which is drilled or piled into position in the conventional manner. After installation of the outer conductor and the formation of a wellhead terrace, a hole for a surface casing 14 is drilled, either in an open hole or through a slipover diverter. The surface casing has a starting head 16 which is run pre-installed on the surface casing 14 and is landed on top of the outer conductor, at 18. A right hand thread running tool 20 which is threaded to a starting head lock nut 22 engages a running assembly 24 which extends up to the rig floor.

Figure 2:
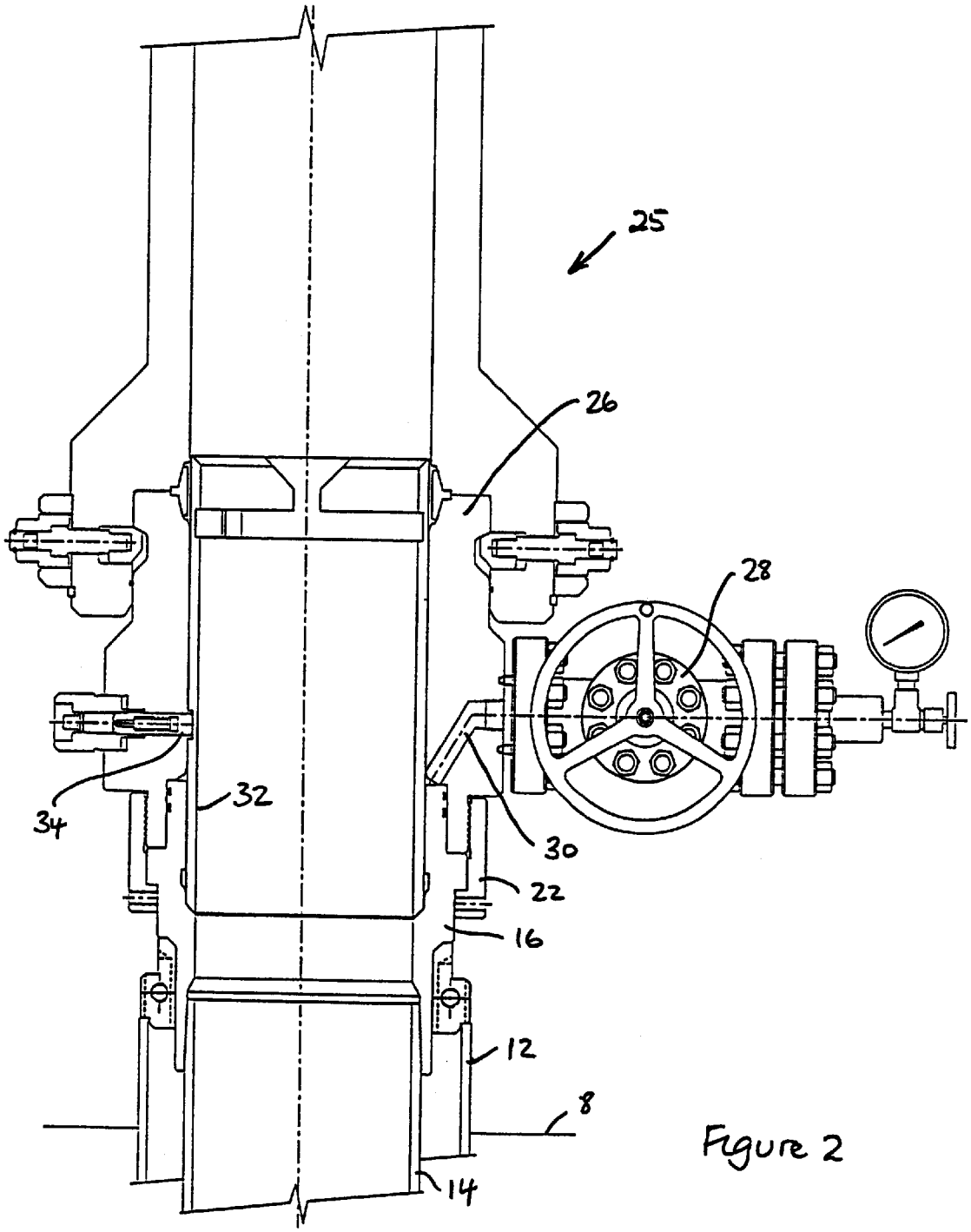

Once the surface casing 14 has been landed, and the surface casing cemented in place then the running assembly 24 is disengaged from the starting head 16. The vacated starting head profile is now used to attach a drilling wellhead generally indicated at 25 on FIG. 2 which has a wellhead spool 26 which engages with the starting head lock nut 22, and with external O-ring seals on the starting head 16. The spool 26 comes with annular valves 28 pre-installed and tested on outlet 30.

After the blow-out preventers have been tested, a nominal wear bushing 32 is installed in the drilling wellhead bore and is locked in position utilising a spring loaded pin 34 which protrudes through the wellhead spool 26, into an annular external groove on the bushing 32.

The well is now prepared for drilling of the production casing hole, through the wear bushing 32 and the surface casing 14.

Once drilling of the production casing hole has been completed, the bushing 32 is retrieved prior to installation of a production casing string.

Figure 3:
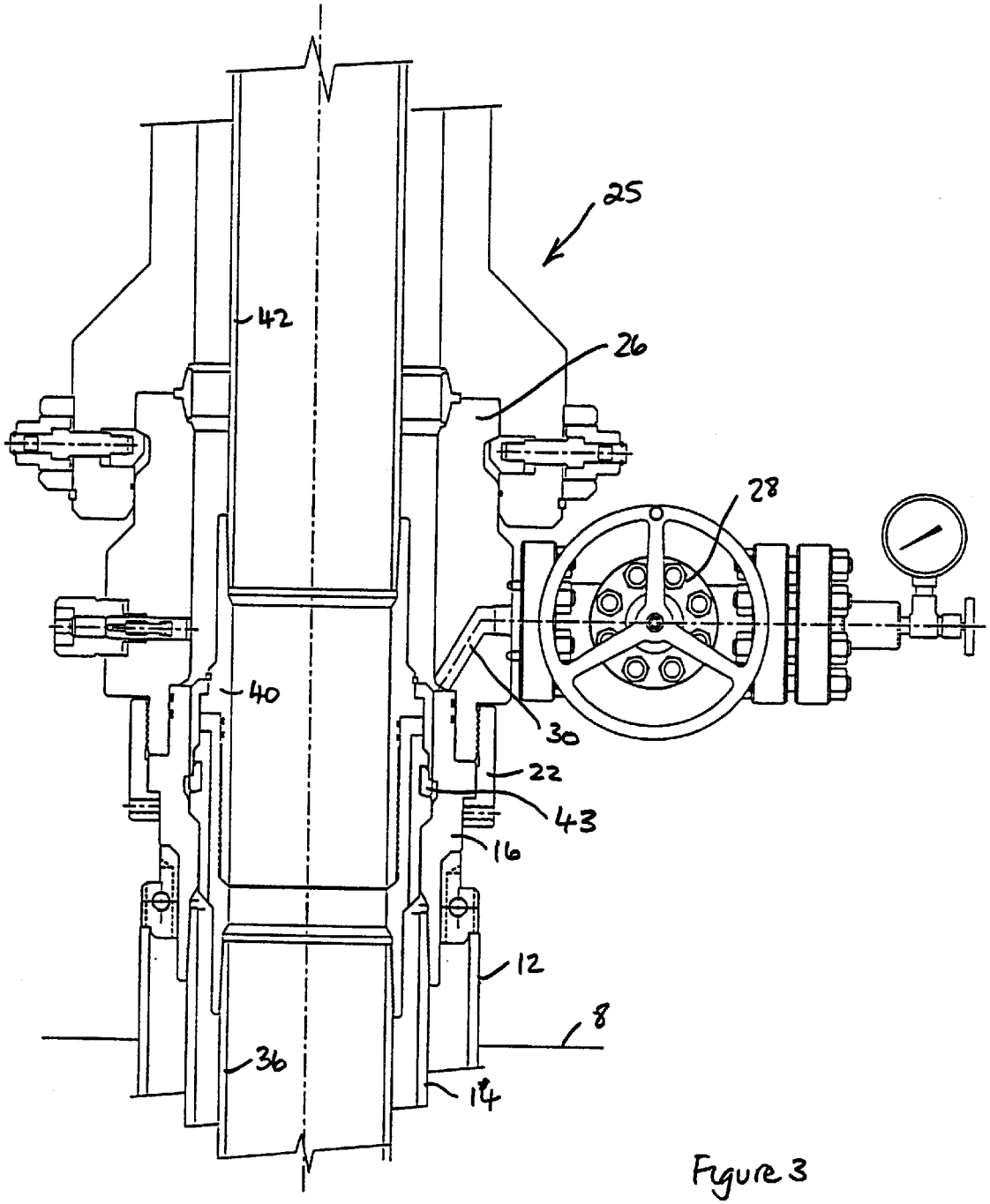
Figure 4:
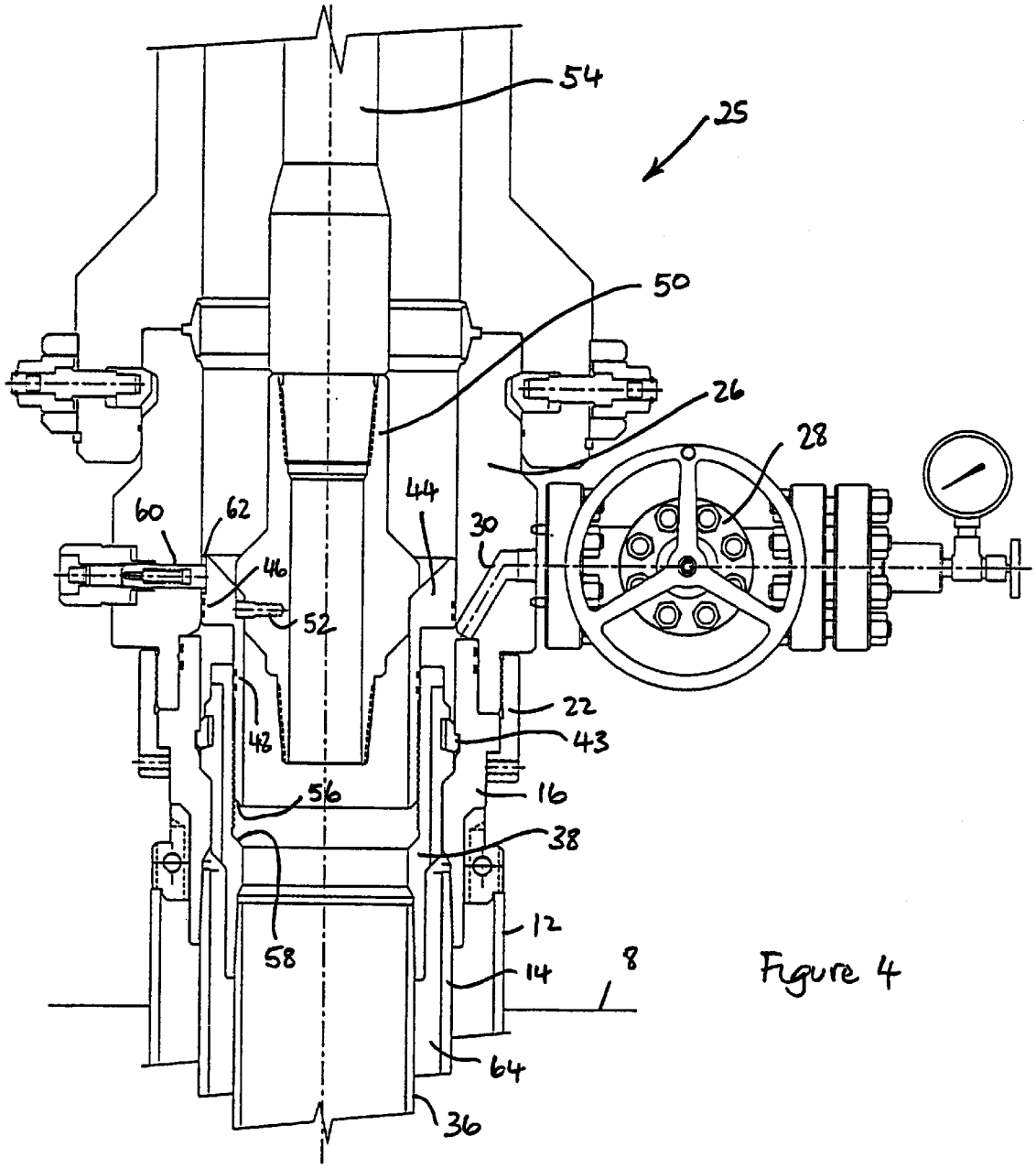

FIG. 3 shows the introduction of the production casing string 36, which is supported on a hanger 38 which is landed on the starting head 16. The string 36 is supported on a running tool 40 which is fitted at the lower end of the running string 42. When the production casing hanger 38 reaches its correct position, the running tool 40 is partially disengaged to allow a lock ring 43 to expand into an annular recess in the internal surface of the starting head 18. The production casing string 36 is then cemented in place using conventional cementing techniques, and the running tool 40 is fully disengaged by rotation in the direction opposite to that used for installation.

After removal of the running tool 40, 42 an annular bowl seal 44 is inserted. This bowl seal which has two sets of external seals in the form of O-rings at 46 and 48 is installed on the end of a bowl seal running tool 50. The tool 50 has a bayonet type connection with the seal 44, through a radial pin 52. The running tool 50 is mounted on the lower end of a running string 54.

On first installation of the seal 44, the seal is run in to a position where the O-ring seals 46 seal in the bore of the drilling wellhead 26, above the outlet 30. Testing can then take place to ensure that the seals 46, 48 are functioning effectively. A spring loaded pin 60 is then advanced into an anti-rotation slot 62 in the seal 44.

With the bowl seal 44 in this position, further drilling and completion procedures can proceed through the running tool 50, with upper section and the skirt of the bowl seal 44 providing, during these procedures, the function of a bowl protector.

In this position, the well can be completed and made ready for production. However, before production commences, the drilling wellhead 24 will be removed and replaced by a production wellhead, and to enable this exchange to take place, the well has to be temporarily sealed. It is necessary to seal (a) the internal bore of the production casing 36, and (b) the annulus which exists between the outer wall of the production casing 36 and the inner wall of the surface casing 14.

The bore 36 is plugged using a conventional casing plug, a wide variety of which are available and well known to the skilled man.

Figure 5:
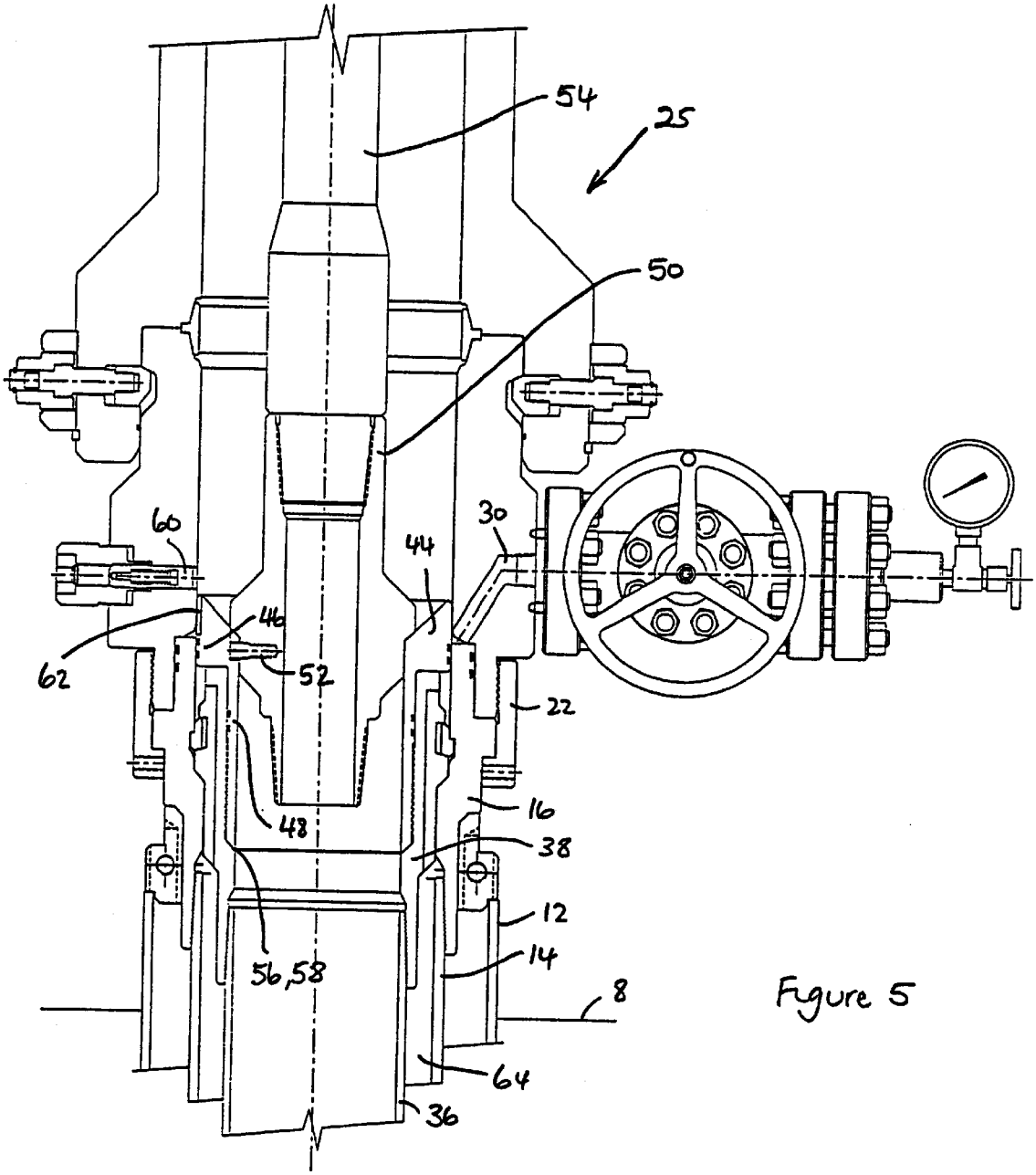

The annulus 64 is plugged by first retracting the anti-rotation pin 60 and then rotating the bowl seal 44 so that it advances down the well, until the metal to metal seal 56, 58 is made and the o-ring seals 46 take up a position where they seal against the upper edge of the surface casing head. This is shown in FIG. 5. At this point the annulus 54 is sealed, and this can be verified.

Figure 6:
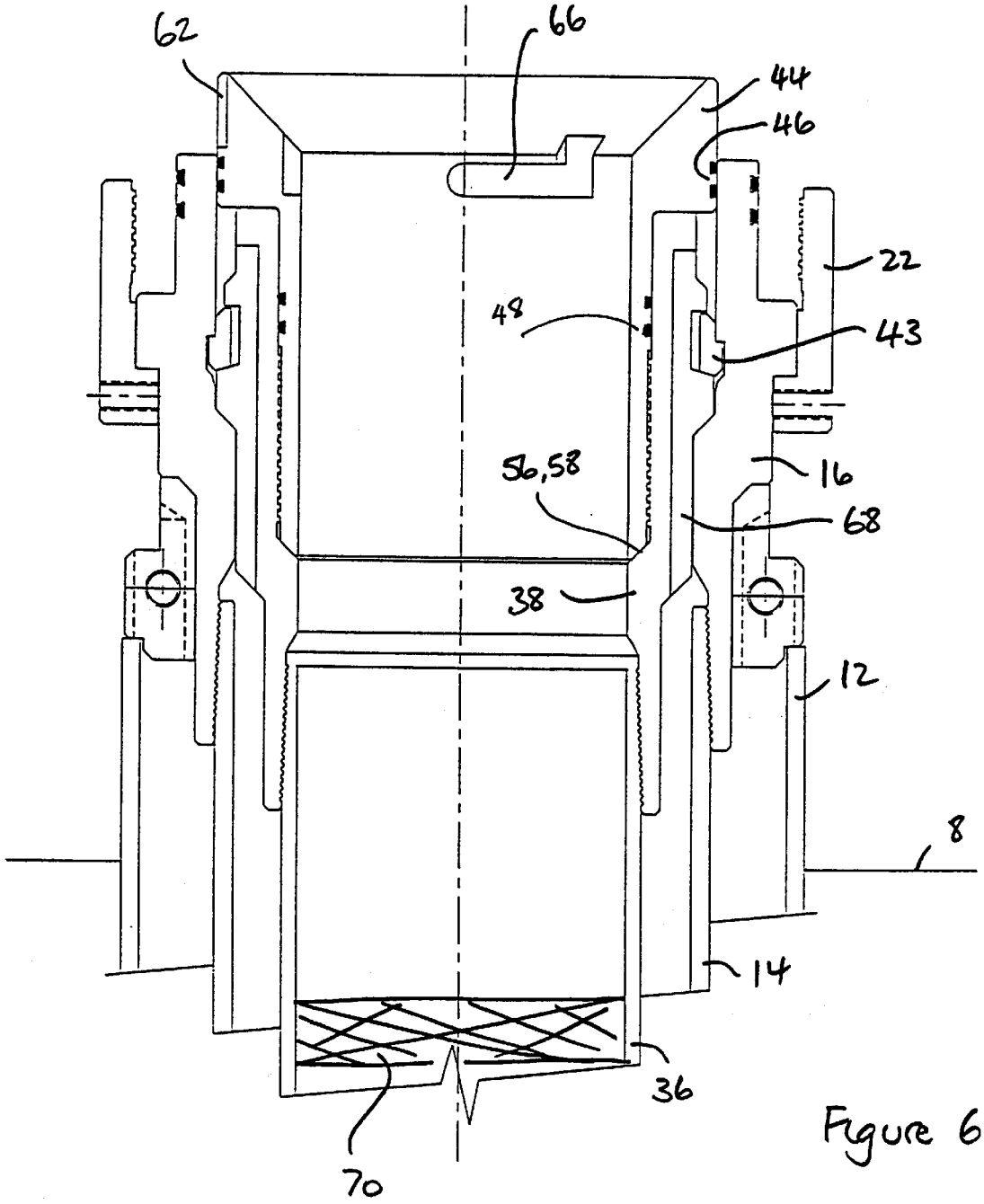

The drilling wellhead 24 can then be removed, leaving the well in the condition shown in FIG. 6. The bowl seal 44 is shown on a larger scale in FIG. 6 and a J-slot 66 can be seen, this being the slot which engages with the pin 52 on the running tool 50.

It can also be seen from FIG. 6 that the production casing hanger 38 has longitudinal slots at 68 which allow the annulus 64 to communicate with the area adjacent to the seals 46, 48.

In this condition, the well is in a temporary abandonment position and it can be left in this state for an extended period of time whilst no production is required from the well.

The casing plug is shown at 70.

Figure 7:
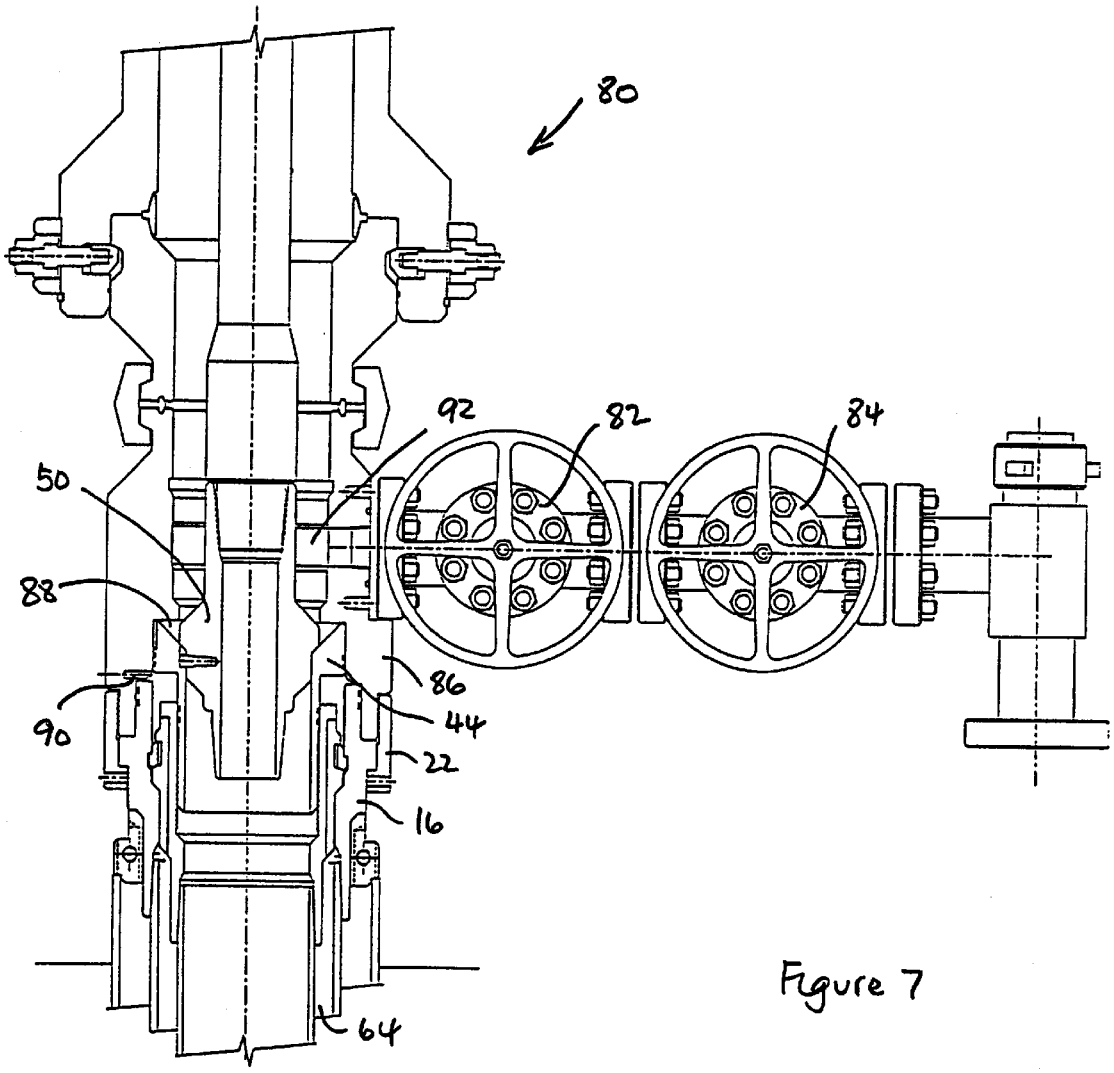
Figure 8:
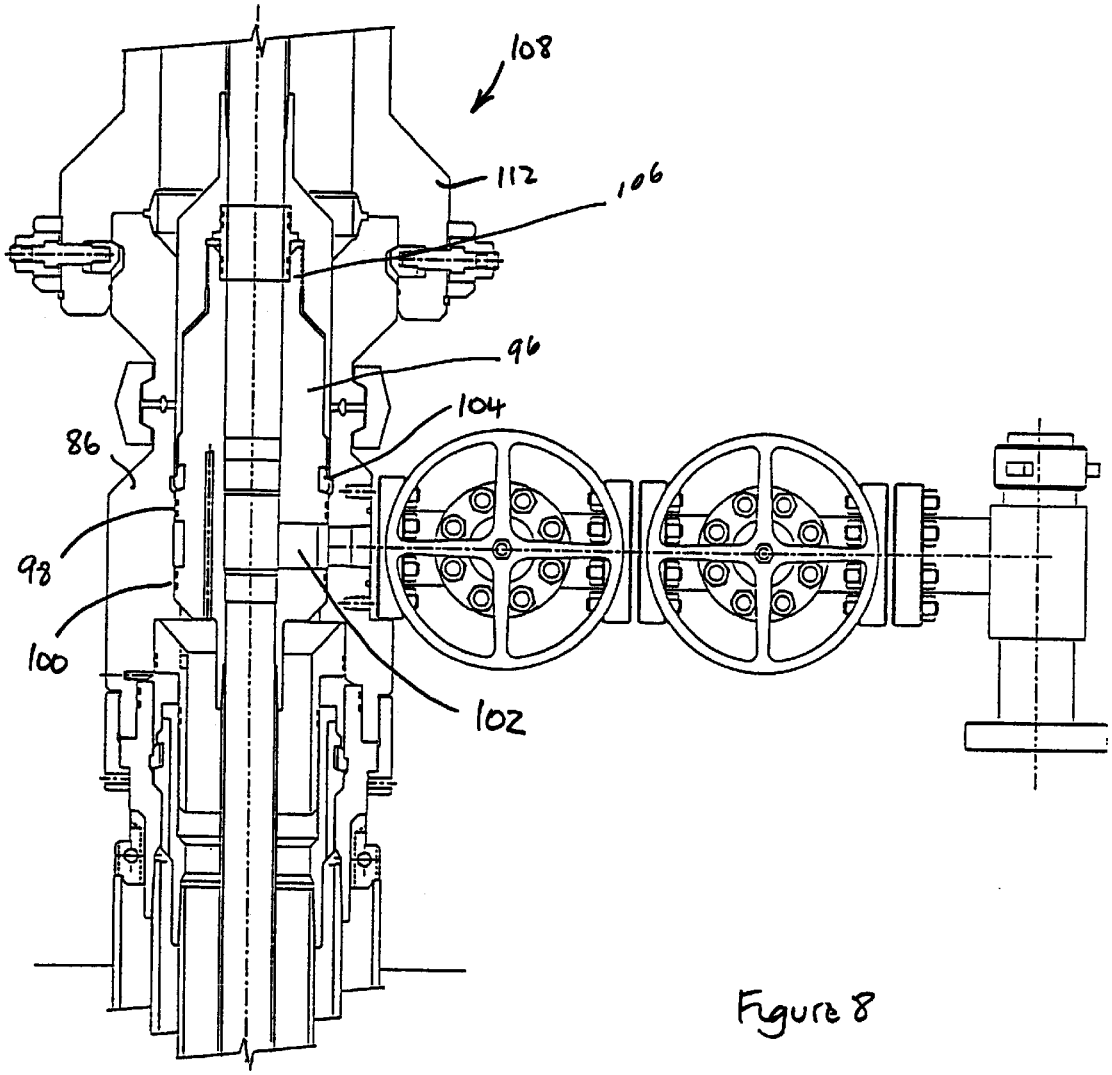
Figure 9:
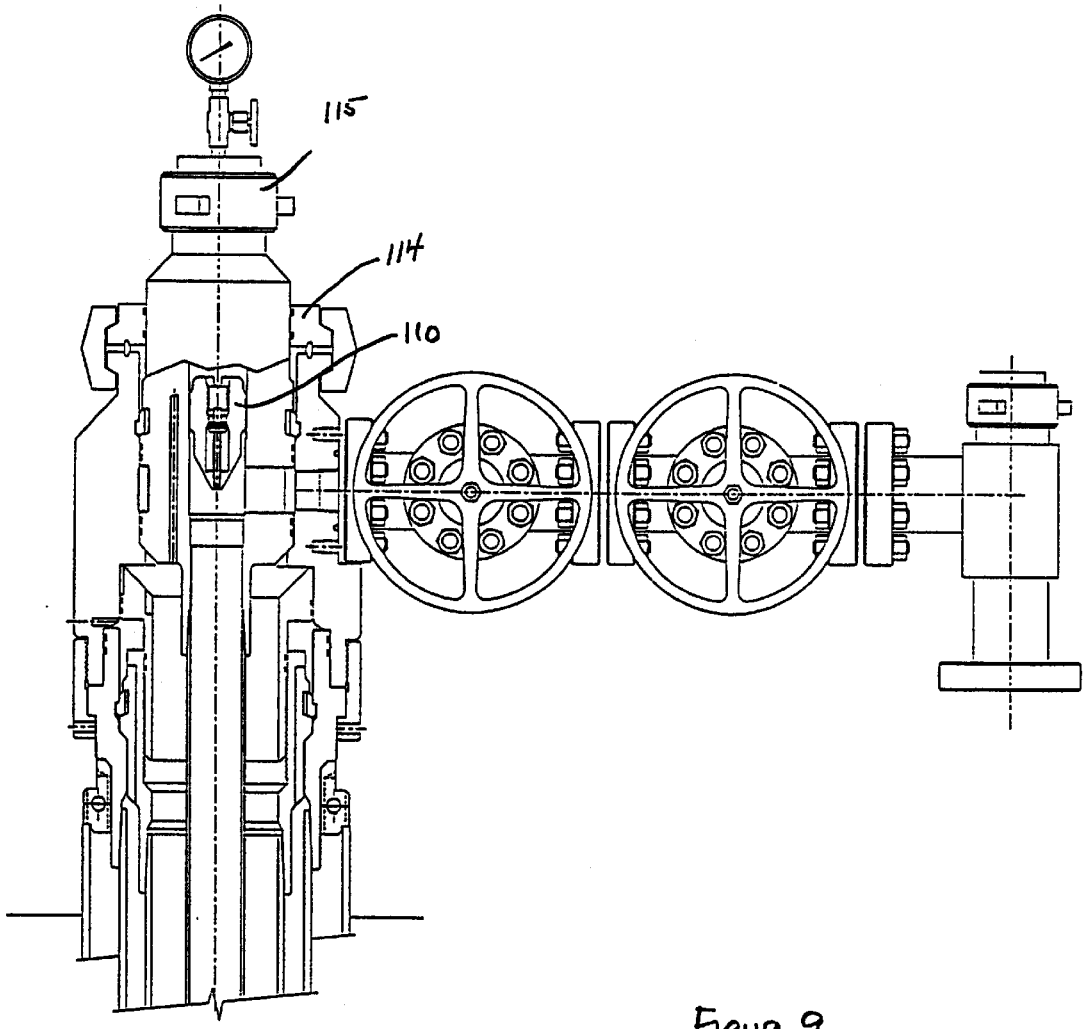

FIGS. 7, 8 and 9 show the well with a production wellhead 80 in place. The production wellhead 80, also called a christmas tree assembly, has production valves 82, 84, although other known valve arrangements can equally be used. The production wellhead 80 will be integrity tested before mounted on the well. Once it has been mounted however, with the wellhead spool 86 engaged on the surface casing hanger 18 and secured with the lock ring 22, it is necessary to raise the bowl seal 44 to re-open communication with the annulus 64. This is done by use of a tool 50, corresponding to the tool previously used through the drilling wellhead 24, and the bowl seal 44 is raised to an upper position as shown in FIG. 7. A stop shoulder 88 in the wellhead spool 86 ensures that the seals 46 are positioned above to an outlet port 90 which then communicates with the annulus 64.

Once the bowl seal 44 has been raised to the position shown in FIG. 7, the running tool 50 can be removed and FIG. 8 shows a side port tubing hanger 96 inserted in the well. External seals 98, 100 are provided above and below the side outlet 102, and a self expanding lock-ring 104 prevents unintended upward movement. The tubing hanger 96 extends above the spool 86 to expose a profile 106 onto which eventually a wire-line workover blow-out preventer which is not shown can be directly attached.

Figure 10:
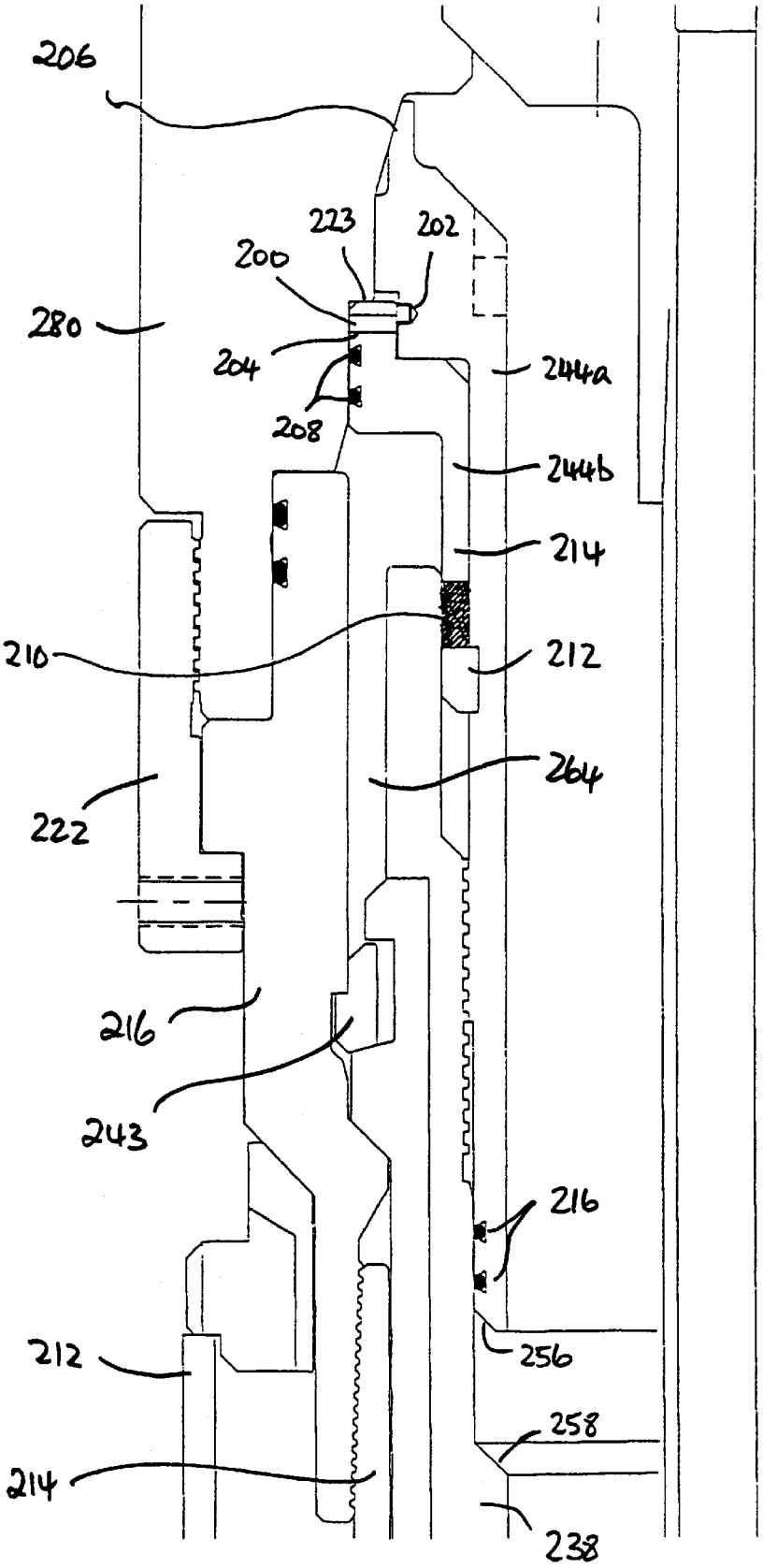
FIG. 10 shows, on a larger scale, an alternative form of bowl seal for use in apparatus of the invention.

Once the tubing hanger has been tested through a set of external test ports and its vertical bore has been sealed with a plug 110, shown in FIG. 10, the drilling riser 112 can be disconnected and a tree cap plate 114 can be installed for additional protection. To protect the tubing hanger upper profile 106 a cap tree 115 is installed.

If electrical downhole pumps are used, cable access can be provided exiting at the upper end of the tubing hanger 116 above the spool 86 and cap plate 114.

Reduced/expanded casing programmes can be equipped with a modified version, see for example FIGS. 13 to 17.

Figure 15:
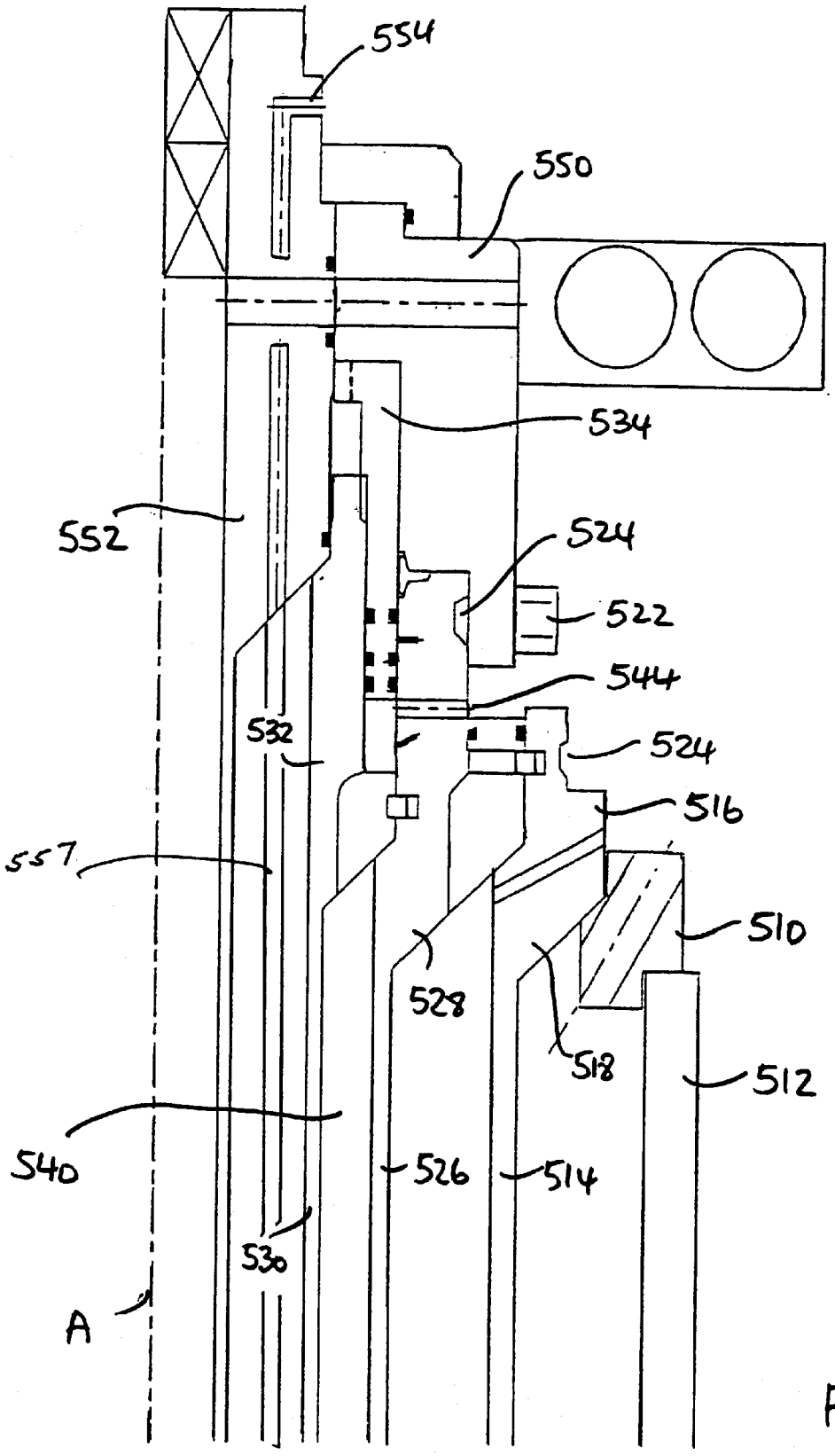
FIG. 15 shows the wellhead of FIGS. 13 and 14 with a second embodiment of tubing hanger and production wellhead fitted to it, in the production phase.

FIG. 10 shows that part of the string where the bowl seal is located. In this Figure, the bowl seal is in two parts, with an outer part 244*b* and an inner part 244*a*. FIG. 15 shows the bowl seal in its raised position (corresponding to the situation in FIG. 7) where the well is ready for production.

Initially, the two seal parts 244*a* and 244*b* are pinned together by a shear pin 200 which extends between a bore 202 in the part 244*a* and a bore 204 in the part 244*b*. In FIG. 10, the pin is shown after having sheared.

The bowl seal 244 has various seal surfaces as follows:

- a metal/metal seal is formed at 206 between the upper rim of the bowl 244 and an inner surface of the production wellhead 280.
- a double O-ring seal is formed by O-rings 208 between the outer bowl part 244*b* and an inner surface of the production wellhead 280.
- a metal to metal compression metal seal 210 is compressed between an abutment ring 212 fixed on the inner bowl part 244*a* and the skirt 214 of the outer bowl part 244*b*. The seal is also constrained between cylindrical surfaces of the production casing hanger 238 and the inner bowl part 244*a* and forms a seal between inner and outer bowl parts.
- a double O-ring seal is formed by O-rings 216 between the inner bowl part 244*a* and an inner surface of the production casing hanger 238.
- a metal/metal seal is formed (when the bowl is in its lower—well abandoned—position) between surfaces 256 and 258 respectively on the bowl part 244*a* and the casing hanger 238.

When this bowl seal is run into the well (which at this time is fitted with the drilling wellhead 26), the shear pin 200 is intact and pins the two parts 244*a* and 244*b* together. The seal 210 is uncompressed and can enter the gap between the part 244*b* and the casing hanger 238. In this position, the annulus 264 is sealed with O-ring seals 216 and 208 and 209.

When the drilling wellhead is to be removed and the well abandoned, the seal 244 is run down into a position where it seals the annulus 264 and

- the seal 244 bottoms on the shoulder 258, and a metal/metal seal is formed here;
- the O-rings 208 come into sealing contact with an inside surface of the surface casing hanger 218;
- the O-rings 216 continue to seal against the inner bore of the hanger 238.

However the shear pin remains intact and the compression seal 210 remains uncompressed.

After the production wellhead 280 has been fitted to the well, the seal 244 is run up with a suitable running tool which engages in a recess 220 provided for this purpose. As the two-part seal 244 reaches the upper limit of its movement, the top of the outer part 244*b* contacts a shoulder 223 on the wellhead 280. Further rotation of the inner seal part 244*a* will cause the pin 200 to shear, whereupon the inner part 244*a* can rise further into the wellhead 238 to make metal/metal seal with the well head at 206, and at the same time the relative movement between the parts 244*a* and 244*b* will result in compression of the seal 212.

In this condition, the metal to metal compression seal 210 backs up the O-ring seals 216 and 209, and the metal/metal seal 206 backs up the O-ring seals 208 and 209.

Figure 11:
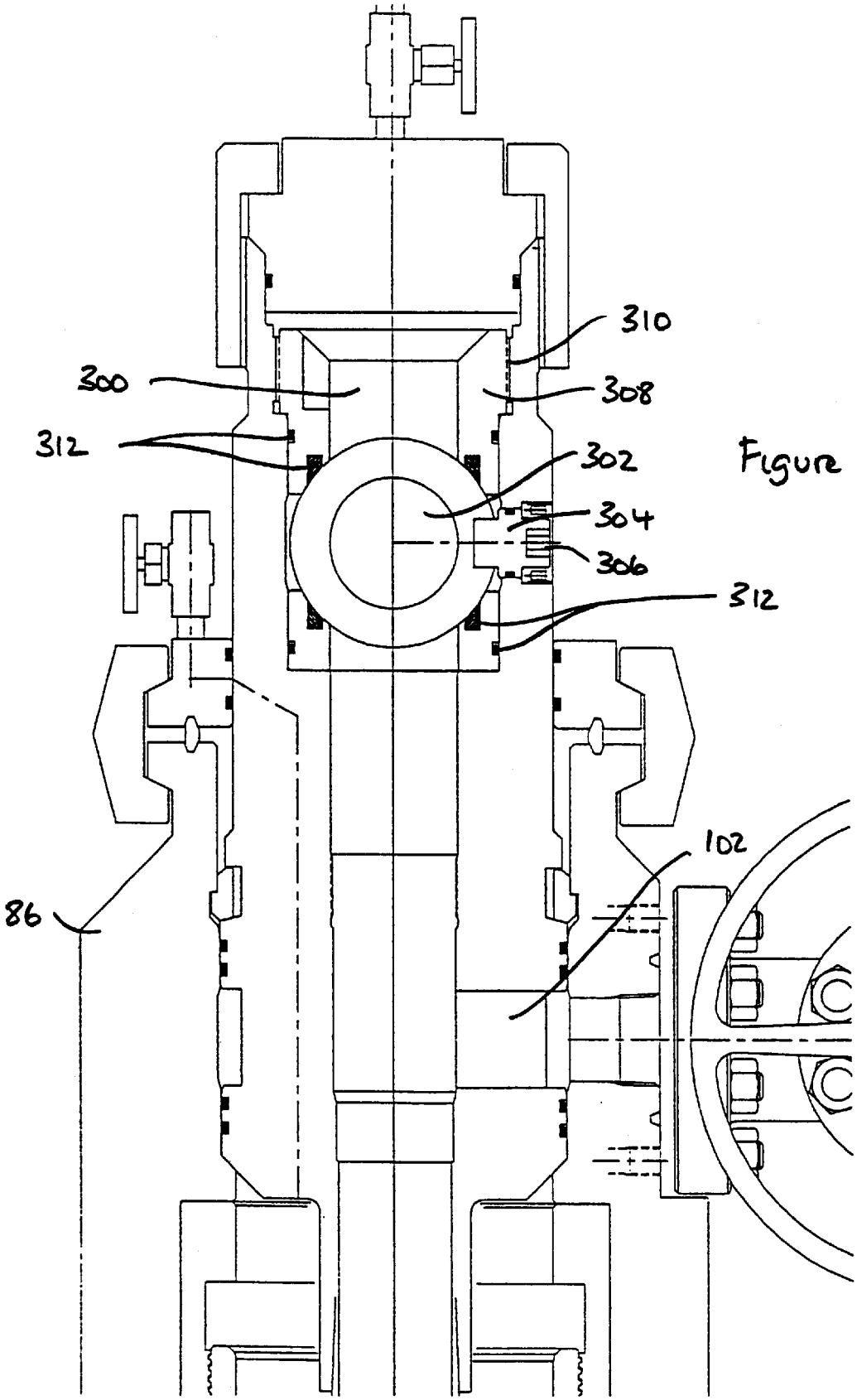
FIG. 11 is a view, partly in section, of a production wellhead for use as part of wellhead apparatus in accordance with the invention.
Figure 12:
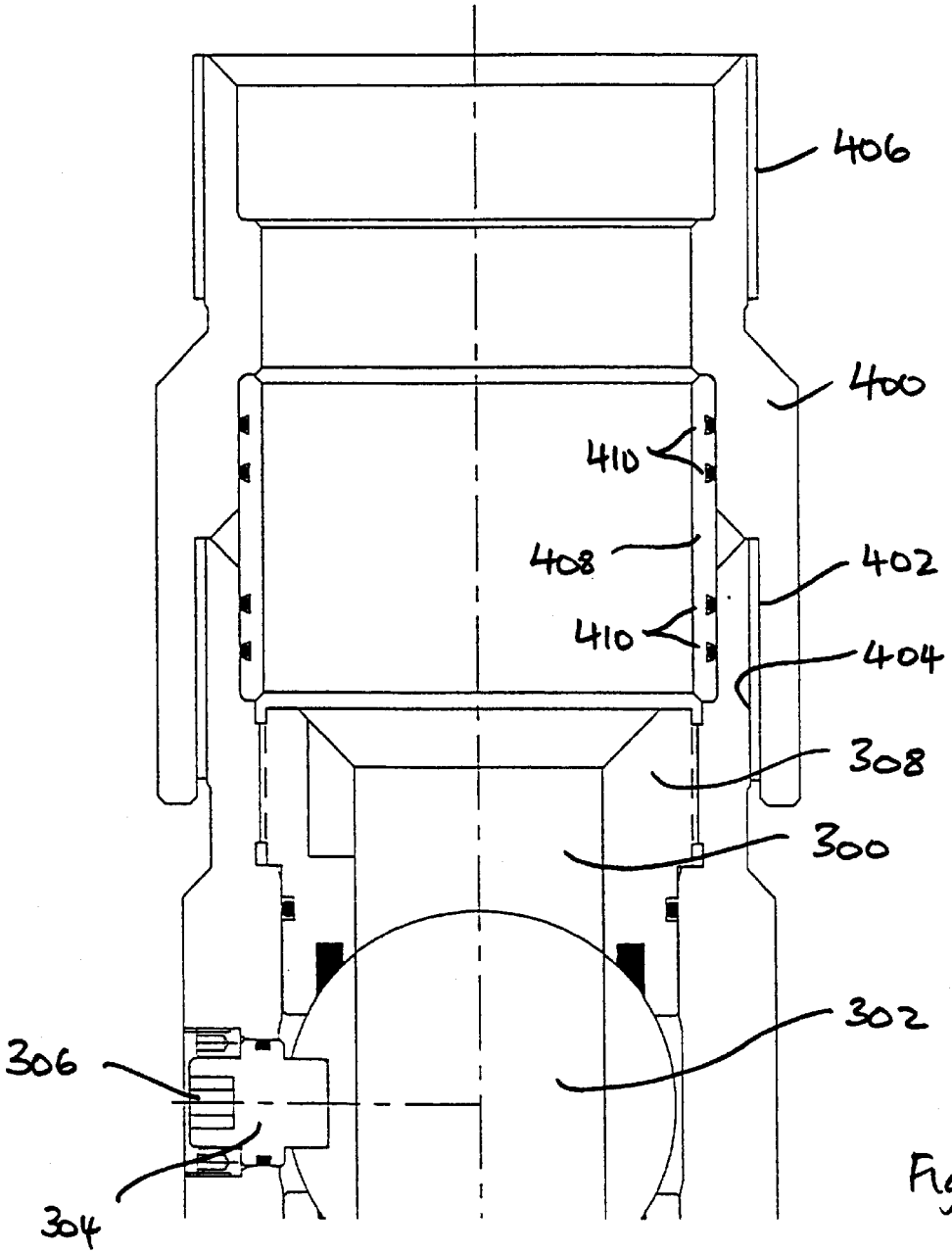
FIG. 12 is a view, on a larger scale of the upper section of a tubing hanger.

FIGS. 11 and 12 show the top end of the wellhead assembly with a ball valve 300 shown in FIG. 11 in the valve closed position and in FIG. 12 in the valve open position. The valve is rotatable about a horizontal axis and has a central bore 302 which can be aligned with the main wellhead bore, to open the valve, or can be positioned across the wellhead bore, to close the valve. A valve actuating connector is shown at 304. This connector has a socket 306 which can engage with a tool which can be used to rotate the valve.

The valve is fitted in a valve body 308 which can be fitted from above in the well head and run into position on a thread 310. Appropriate seals are provided at 312.

Above the valve 300 is a removable sub 400 which has a thread 402 engaging with a thread 404 on the top of the wellhead body. The sub 400 also has an external thread 406 onto which a tree cap (as shown at 115 in FIG. 9) can be fitted. A seal sleeve 408 has external O-ring seals 410 to seal between the sub 400 and the wellhead body.

The removable sub 400 will be the first component to receive wear when attaching the workover blow-out preventers. If any damage is caused to the top of the well when the well is entered, the wear will take place on the sub 400 which can be easily replaced at relatively low cost, to reinstate the well to its proper condition.

An alternative wellhead design is shown in FIGS. 13 to 17. In these figures, only one side of the wellhead is shown, and the dotted line A represents the well centre line.

This alternative design has a conductor landing ring 510 supported on a conductor casing 512 which is fixed in the ground 508. A surface casing 514 has a hanger sub 516 with a shoulder 518 which supports the sub on the landing ring 510, and the top of the sub 516 has a drilling wellhead 520 removably fixed to it, by fastenings 522 which locate in an annular recess 524 in the upper collar region of the sub 516. The drilling wellhead 520 is only installed after inserting annular seal 535 in the annular area below hanger 528 and hanger 516. The drilling wellhead 520 is isolated from any casing load.

An intermediate casing 526 has a hanger 528 which supports the casing on the surface casing 514. A production casing 530 has a hanger 532 by which it is supported on the intermediate casing 526.

Figure 13:
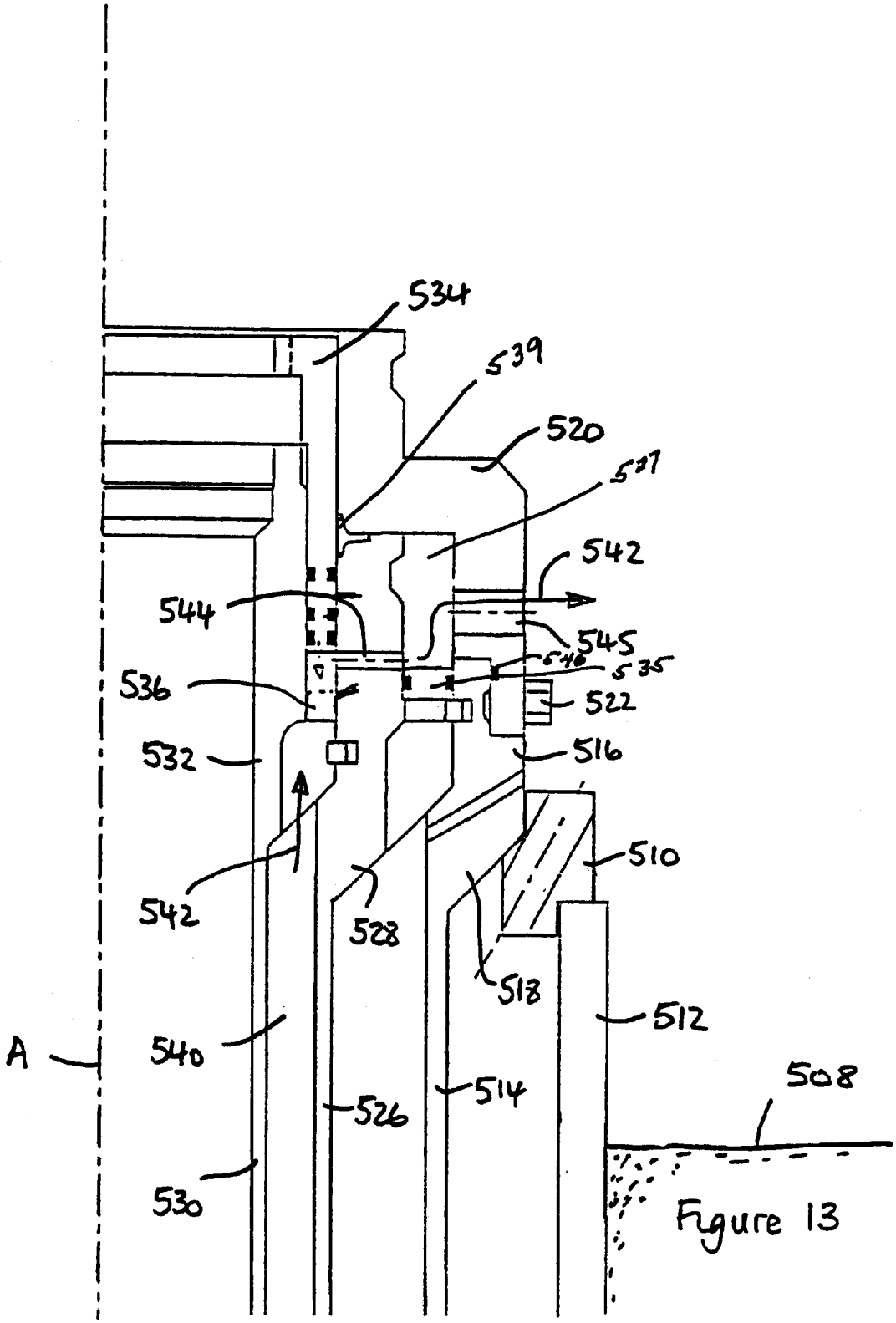
FIG. 13 is a partial section through a second embodiment of wellhead apparatus in accordance with the invention, in the drilling phase.
Figure 14:
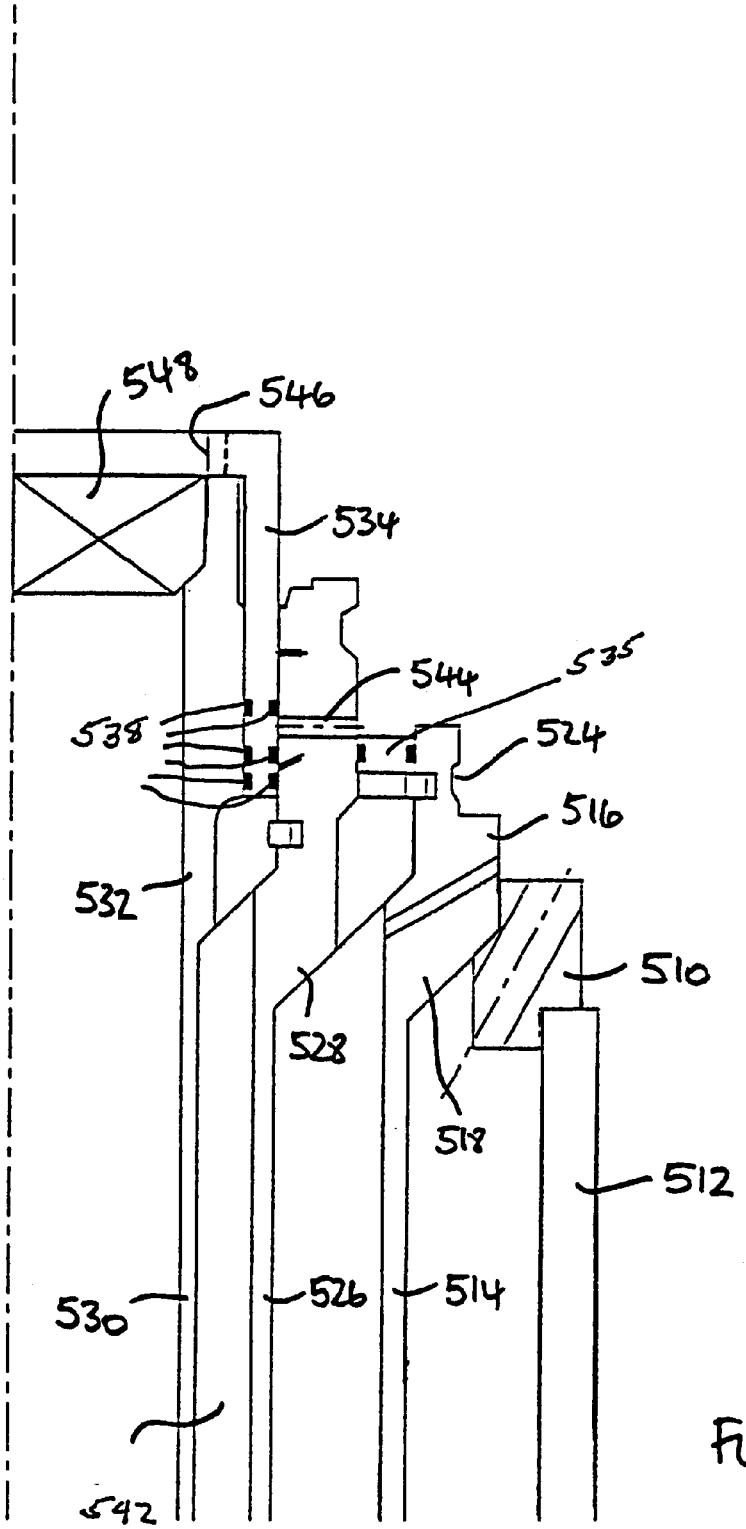
FIG. 14 shows the wellhead of FIG. 13 in the temporarily abandoned phase.

An annular cylindrical seal ring 534 is fitted between the intermediate and production casing hangers 528, 532, in an annular cylindrical space 536. In FIG. 13, the ring 534 is located in its upper position. The ring 534 has seals 538 on both its inner and outer cylindrical surfaces which seal against the adjacent surfaces of the intermediate and production casing hangers 528 and 532.

The well is drilled with the seal ring in this position. The well can be drilled through a conventional compact wellhead system utilising mandrel type casing hangers with flow-by capability and the production casing annular seal in the form of the seal ring 534 installed through the blow out preventers. The drilling system locates on the drilling wellhead 520.

Whilst the well is being drilled, the annular space 540 between the intermediate and production casings is vented through a path indicated by arrows 542, and therefore through a radial passage 544 in the intermediate casing hanger 28 and a passage 545 in the wellhead 520. The vents will normally, during this stage, be connected to annulus pressure monitoring equipment. The space 536 above the passage 544 is sealed by the ring 534. The space 537 is sealed by ring 537, O-ring 546 and seal ring 539.

Once drilling has been completed, ie the well has reached TD, the drilling wellhead 520 can be removed (for reuse on another well), and the well can then be temporarily abandoned. The seal ring 534 is first moved down into the space 536, so that the seals 538 form a seal with the casing hangers 528 and 532 to close communication between the annular space 542 and the passage 544.

The seal ring can be moved axially by one of a variety of mechanisms, including those conventionally used in rotating components within a drill string. For example the ring may have an internal thread which meshes with an external thread on the upper rim of the production casing hanger 532, so that the ring can be screwed up or down in the space 536 to move between two distinct sealing positions. The ring can have internal slots 546 for engagement with a torque tool to turn the ring. However other different mechanisms may be used to raise and lower the ring.

Next, a conventional temporary bore cap 548 (FIG. 14) is fitted in the well bore.

Then the wellhead 520 is removed. Once the wellhead has been removed, it can be reused on another well, for the well drilling phase of that well.

The well is then in an abandoned (but safe) situation, but can be brought quickly back into operation.

Figure 16:
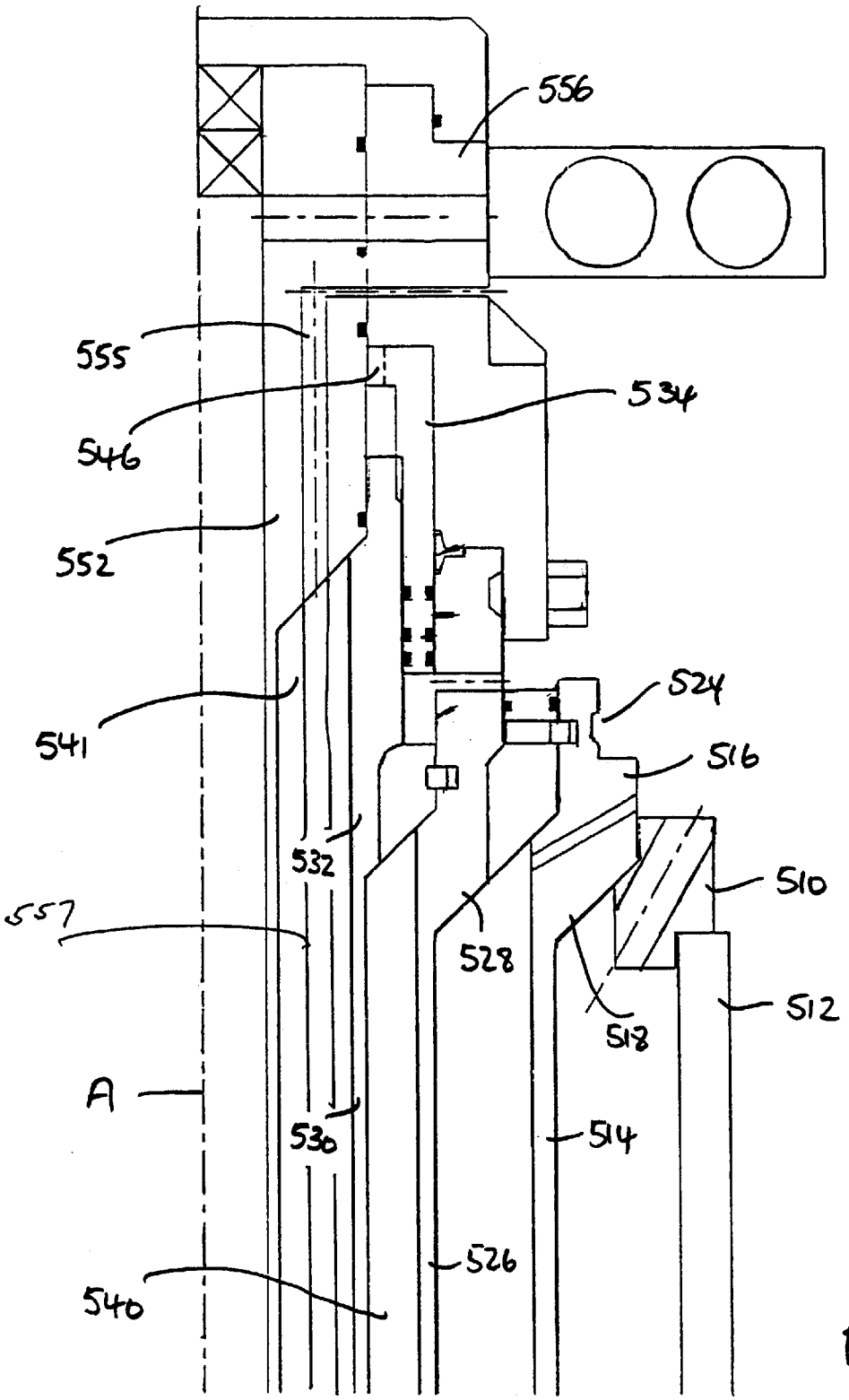
FIG. 16 shows the wellhead of FIGS. 13 and 14 with a third embodiment of tubing hanger and production wellhead fitted to it, also in the production phase.
Figure 17:
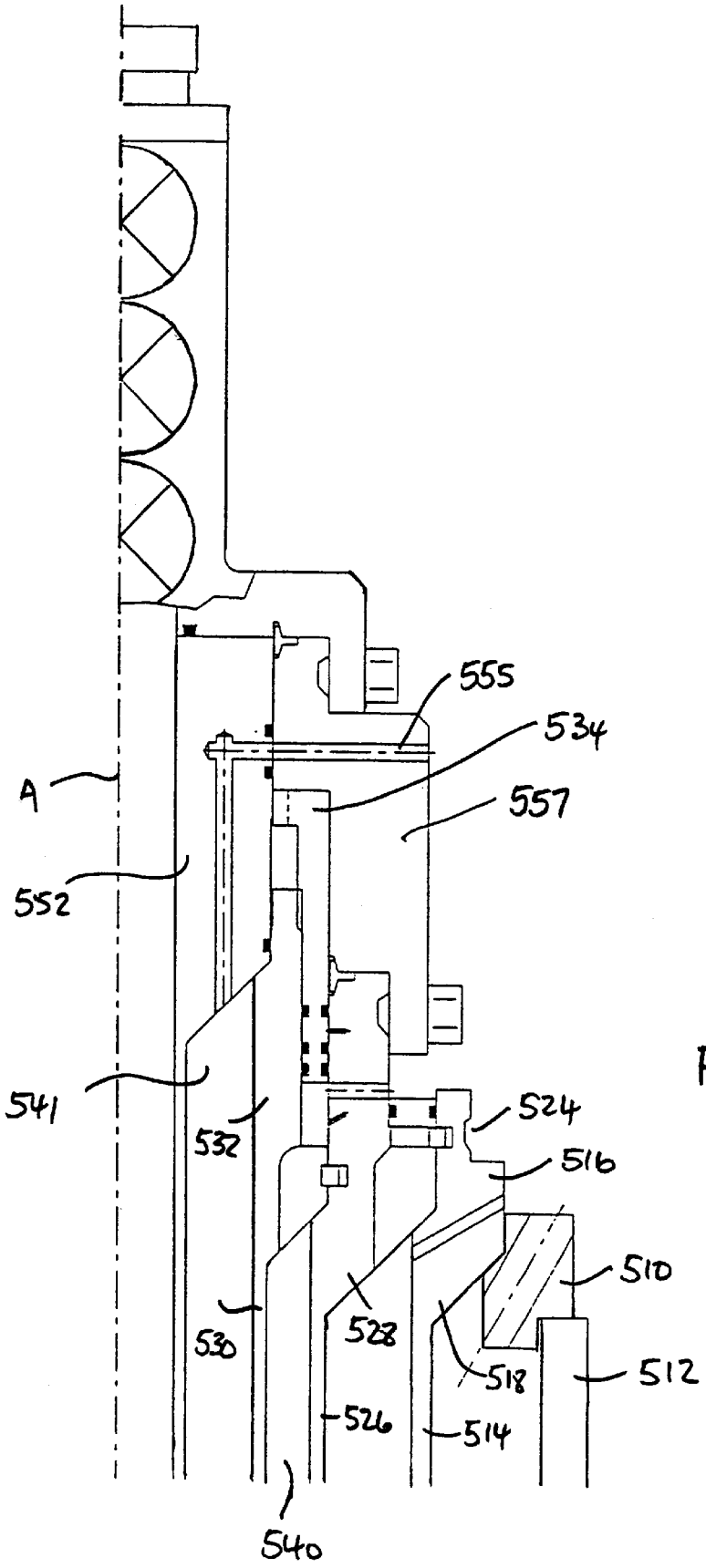
FIG. 17 shows the wellhead of FIGS. 13 and 14 with a fourth embodiment of tubing hanger and production wellhead fitted to it, and with a conventional production tree also fitted, for the production phase.

When the well is to be brought into production, a production wellhead housing 550 (shown schematically in FIG. 15) is fitted on the abandoned casing hanger cluster and engaged with the casing hanger by fastenings 522 which locate in the same annular recesses 524 as were used to engage the drilling wellhead with the casing hanger. The production wellhead 550 has all the functionality associated with a conventional well christmas tree assembly as shown in FIG. 17, or with a cantilever christmas tree assembly as depicted in FIGS. 15 and 16. After fitting the production wellhead, the wellhead is tested and on completion of testing and after reinstallation of the blow out preventers, the seal ring 534 is lifted from its lower sealing position to re-establish communication through the passage 544, and the temporary bore cap 548 is removed through the blow out preventers.

The production wellhead is now ready to accept a tubing hanger 552 which extends above the production casing cluster and into which a wireline blow out preventer can be attached.

A control line port 554 through the extended neck of the tubing hanger 552 can be provided.

FIG. 16 shows an alternative configuration in which the control line 557 can be exited through a port 555 which exits through the production wellhead body 556.

FIG. 17 shows the production wellhead with a conventional production tree 557 fitted, for the production phase.

FIG. 15 shows a four string well design.

The systems described here allow quick and simple removal of a wellhead dedicated to the drilling stages, and its substitution by a production wellhead dedicated to production. This process takes place under the protection of an annular seal system which can also be used as a temporary abandonment system which allows the re-establishment of annular access after the production wellhead has been installed and tested. There will be no danger of the production wellhead being damaged by or during the course of drilling, and any steps which might otherwise be taken to resist such damage can be minimised or omitted resulting in lower costs and reduced complexity.

On the other hand, the drilling wellhead can be made simple and robust, and this will enable it to be used over and over again (possibly with some intermediate renovation) on a number of different well drilling sites, again simplifying design requirements and lowering costs. The overall height of a producing well will be lowered sufficiently as a result of this invention.

What is claimed is:

1. A method of drilling a well and preparing it for production, the method comprising the steps of providing a drilling wellhead for the drilling stage, drilling the well, installing concentric tubing strings in the well and when drilling is completed, sealing the well and sealing a production annulus formed between casing strings; installing a production wellhead on the well and then unsealing the well bore and opening communication with the production annulus so that production can take place through the production wellhead whilst the production annulus is monitored.

2. A method as claimed in claim 1, wherein communication with the production annulus is opened through a blow out preventer.

3. A method as claimed in claim 1, wherein the production annulus is provided with a seal ring which is movable between a sealing position for sealing the annulus and an open position for opening communication with the annulus.

4. A method as claimed in claim 3, wherein the seal ring is movable axially between sealing and open positions.

5. A method as claimed in claim 3, wherein the seal ring is mounted on a thread and is moved between sealing and open positions by rotating the ring on its thread.

6. A method as claimed in claim 3, wherein the seal ring is moved with a tool inserted axially into the well.

7. A method as claimed in claim 1, wherein the seal ring seals with the production wellhead and with the production casing when in the open position.

8. A method as claimed in claim 1, wherein the seal ring also forms a wellhead bowl protector.

9. A method as claimed in claim 1, wherein the well is sealed by fitting a sealing cap within the well bore.

10. Wellhead apparatus comprising a casing hanger cluster including a plurality of concentric casing hangers, a seal ring, means for moving the seal ring in opposed axial directions in the cluster to close communication between an annular space defined between one casing hanger in the cluster and the next outermost casing hanger and to subsequently re-open said communication, a drilling wellhead and a production wellhead, the drilling and production wellheads being adapted to be fitted alternately on the cluster.

11. Wellhead apparatus as claimed in claim 10, wherein the seal ring comprises a tubular body, with seals on its radially internal and radially external faces which seal with, respectively, the radially external face of one casing string and the radially internal face of a next outermost casing string.

12. Wellhead apparatus as claimed in claim 10, wherein the seal ring comprises a cylindrical body with at least two sets of seals on radially external faces, the seals being arranged at different diameters, the smaller diameter set of seals being arranged to seal with one casing hanger and the larger diameter set being arranged to seal with a next outermost casing hanger at a point where the next outermost casing hanger is not overlapped by the said one casing hanger.

13. Wellhead apparatus as claimed in claim 12, wherein the seal ring includes an axially extending skirt which acts as a bowl protector in the wellhead.

14. Wellhead apparatus as claimed in claim 13, wherein the seal ring has one set of seals at one end, and a second set carried by the lower end of the skirt.

15. Wellhead apparatus as claimed in claim 12, wherein the seal ring has surfaces which make metal/metal seals with mating faces of the casing strings.

16. Wellhead apparatus as claimed in claim 12, wherein the seal ring is in two parts which are held in a first relative position by a shear pin, and wherein a compression seal is located between the two parts, the compression seal being uncompressed when the parts are in their first relative position, but being compressed when the parts move to a second relative position after the shear pin has sheared.

17. Wellhead apparatus as claimed in claim 12, wherein the seal ring has an upper tapered surface for making a metal/metal seal with a corresponding surface of a production wellhead, and a lower tapered surface for making a metal/metal seal with a corresponding surface of a production casing hanger.

18. Wellhead apparatus as claimed in claim 17, wherein the seal ring also has O-ring seals for sealing with inner and outer casing strings and with a production wellhead.

19. Wellhead apparatus as claimed in claim 10, wherein the seal ring is mounted on a thread, and can be moved between the seal open and seal closed positions by rotating the ring on its thread.

* * * * *